US006712340B1

(12) United States Patent
Clarmont

(10) Patent No.: US 6,712,340 B1
(45) Date of Patent: Mar. 30, 2004

(54) WEATHER RESISTANT FENCE COVERING

(76) Inventor: Alain Clarmont, 100 Des Palmino, Gatineau, Quebec (CA), J8R 3M8

( * ) Notice: Subject to any disclaimer, the term of this patent is extended or adjusted under 35 U.S.C. 154(b) by 5 days.

(21) Appl. No.: 10/165,327

(22) Filed: Jun. 6, 2002

(51) Int. Cl.[7] ..... E04H 17/14

(52) U.S. Cl. ..... 256/19; 256/23; 256/24; 256/59

(58) Field of Search ..... 256/1, 19, 24, 256/25, 29, 30, 31, 59, 66, 73, 65.06, 23

(56) References Cited

U.S. PATENT DOCUMENTS 4,753,420 A * 6/1988 Kaaria ..... 256/59
5,702,090 A * 12/1997 Edgman ..... 256/19
5,772,185 A * 6/1998 Pulsipher ..... 256/59
5,794,390 A * 8/1998 Oliveri et al. ..... 256/19
6,152,428 A * 11/2000 Simioni ..... 256/24
6,299,142 B1 * 10/2001 Chaney et al. ..... 256/19
6,311,955 B1 * 11/2001 McGarry et al. ..... 256/24
6,393,791 B1 * 5/2002 Mann ..... 256/24
6,398,193 B1 * 6/2002 DeSouza ..... 256/19
6,494,438 B1 * 12/2002 Noirot et al. ..... 256/19
6,588,732 B1 * 7/2003 Caceres et al. ..... 256/19

* cited by examiner

*Primary Examiner*—Frederick L. Lagman

(57) ABSTRACT

A weather resistant fence covering that is attachable to the top rail of fence, while covering most of the rail of the top railing and any exposed ends thereof, and a side covering component that is attachable to the boards of a wooden fence so as to prevent weathering, hide knots, splintered wood, discolored wood, and cracks in the wood while providing a uniform look that will not rot. The weather resistant fence covering includes a top covering component, a corner covering component and a side covering component. The top covering component covers most of the rail of the railing. The corner covering component joins facing ends of the top covering component that are adjacent and not collinearlly-aligned.

4 Claims, 4 Drawing Sheets

WEATHER RESISTANT FENCE COVERING

BACKGROUND OF THE INVENTION

1. Field of the Invention

The present invention relates to a weather resistant fence cover for use in connection with fencing materials. The weather resistant fence cover has particular utility in connection with covering the less durable fence and post elements that comprise a wooden fence, while simultaneously providing aesthetic enhancement.

1. Description of the Prior Art

The use of wood in construction of fences is common. Wood is widely available and easily worked. Wood can be painted or stained to provide some weather and wear resistance, but no finish can provide complete wear and weather protection. There is an increasing tendency to make fences of metal, but that is an expensive proposition compared with the use of wood. All PVC fences are also weather resistant but are more expensive than the described invention. The weather resistant fence cover is desirable for providing an attractive, durable and economical alternative to all metal fencing.

The use of structural coverings in fencing materials is known in the prior art. For example, U.S. Pat. No. 5,794,390 to Oliveri et al. discloses a structural covering for deck railings and floorboards. However, the Oliveri '390 patent does not describe the invention at hand, in that the protective covering is provided for the top rail of the fence only, and has further drawbacks of being designed in discrete segments, one covering per board, and thus does not provide protection for the entire structural entity.

U.S. Pat. No. 5,326,187 to St. Marie et al discloses a cover for a fence rail that also utilizes a material with better wear and weather resistant properties than wood, for protection of the top rail. However, the St. Marie '187 patent does not cover and thus protect the whole fence, merely the top rail, and additionally does not provide the shielded design of the present invention's top rail design, which covers the side covering component of the present invention, as well as aids in the dispersal of rain and snow.

Similarly, U.S. Pat. No. 4,181,764 to Totten discloses a fence rail covering and method of making the railing that provides weather and abrasion resistance. However, the Totten '764 patent does not cover the entire fence structure from the effects of weather, and can not provide the privacy and screening inherent in the fence of the present invention.

Additionally, U.S. Pat. No. 5,458,942 to Miller discloses a form fitting fence rail covering that provides wear and weather resistance. However, the Miller '942 patent does not contain the same elements as the present invention, and has the additional deficiency of not providing privacy and screening, which could be desirable in a residential setting.

Also, U.S. Pat. No. 4,516,756 to Beatty discloses a covering for fence members that is adaptable for both rails and posts. However, the Beatty '756 patent does not contain the same elements as the present invention, and has the additional deficiency of being better suited for upright fencing materials than horizontal fencing materials. Lastly, U.S. Pat. No. Des. 257,177 to Demarest discloses a fence design that consists of panels. However, the Demarest '177 patent does not contain the same structural elements, and has the additional deficiency of not providing the utility of complete structural covering for the fence.

While the above-described devices fulfill their respective, particular objectives and requirements, the aforementioned patents do not describe a weather resistant fence cover that allows for complete covering of all elements of the fence structure. The patents also do not describe an invention with the ease of exchange of the side covering component elements as contained in the present invention. The various patents also make no provision for the privacy and security that is desirable in a residential fence.

Therefore, a need exists for a new and improved weather resistant fence cover that can be used for residential fencing. In this regard, the present invention substantially fulfills this need. In this respect, the weather resistant fence cover according to the present invention substantially departs from the conventional concepts and designs of the prior art, and in doing so provides an apparatus primarily developed for the purpose of aesthetically pleasing, cost effective fencing.

SUMMARY OF THE INVENTION

In view of the foregoing disadvantages inherent in the known types of fence coverings now present in the prior art, the present invention provides an improved weather resistant fence cover, and overcomes the above-mentioned disadvantages and drawbacks of the prior art. As such, the general purpose of the present invention, which will be described subsequently in greater detail, is to provide a new and improved weather resistant fence cover which has all the advantages of the prior art mentioned heretofore and many novel features that result in a weather resistant fence cover which is not anticipated, rendered obvious, suggested, or even implied by the prior art, either alone or in any combination thereof.

To attain this, the present invention essentially comprises a covering for a wooden fence structure. The fence is composed of two by four boards horizontally attached to four by four posts. The top two by four has another two by four joined to it perpendicularly to form a T-shape. The T-shape strengthens the fence to help prevent warping, and allows for a quick change-out of boards should any warping occur. The top board has an extruded plastic covering, with sides at the outer edges that curve down in a J shape to cover the top of the side covering component. The top covering component would be attached to the top two by four by flanges that would slide over the sides of the two by four. There are no ribs or projections on the bottom of the top covering component, so that the cover sits tightly on top of the board.

The corner covering component is also formed of extruded plastic and is used where the fence joins to make a corner. The corner covering component also has sides at the outer edges that curve down in a J shape to cover the top of the side covering component. The corner covering component would be attached to the top two by four by flanges that would slide over the sides of the two by four. There are no ribs or projections on the bottom of the corner covering component, so that the cover sits tightly on top of the board.

The side covering component is composed of siding, usually vinyl, attached to the fence by the usual means of attachment, usually nails, in a vertical rather than horizontal orientation. The siding can be easily changed out should a piece become damaged. The use of siding ensures that the cost of the fence can be kept low while providing the low maintenance and aesthetically pleasing looks of a PVC or metal fence.

There has thus been outlined, rather broadly, the more important features of the invention in order that the detailed description thereof that follows may be better understood and in order that the present contribution to the art may be better appreciated.

The invention may also include a finial or other topping at either the corner or along the top covering component. There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other Fence Covers, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved fence design that has all of the advantages of the prior art rail coverings and none of the disadvantages.

It is another object of the present invention to provide a new and improved fence design that may be easily and efficiently manufactured and marketed.

An even further object of the present invention is to provide a new and improved fence design that has a low cost of manufacture with regard to both materials and labor, and which accordingly is then susceptible of low prices of sale to the consuming public, thereby making such fence design economically available to the buying public. The fence could also be manufactured and sold in ways that would make the fence easy for homeowners or others, to purchase and install with a minimum of time and work. The fence could come in a detailed assembly format with instructions that the purchaser could easily follow. The purchaser could simply purchase the amount of material needed to complete the installation.

Still another object of the present invention is to provide a new fence design that provides in the apparatuses and methods of the prior art some of the advantages thereof, while simultaneously overcoming some of the disadvantages normally associated therewith.

Even still another object of the present invention is to provide a weather resistant fence cover for increased privacy in a residential setting. This allows the homeowner to enjoy their backyard, without the expense involved in the installation of the usual fences installed for screening. The fence cover also provides increased security.

Still yet another object of the present invention is to provide a weather resistant fence cover that is low maintenance. This makes it possible to install the fence and then rely on the inherent low maintenance of vinyl siding.

The present invention combines the strength and flexibility of a wooden fence structure with the low maintenance of extruded plastic, to deliver a low cost, esthetically pleasing fence.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE PREFERRED EMBODIMENT

Figure 1:
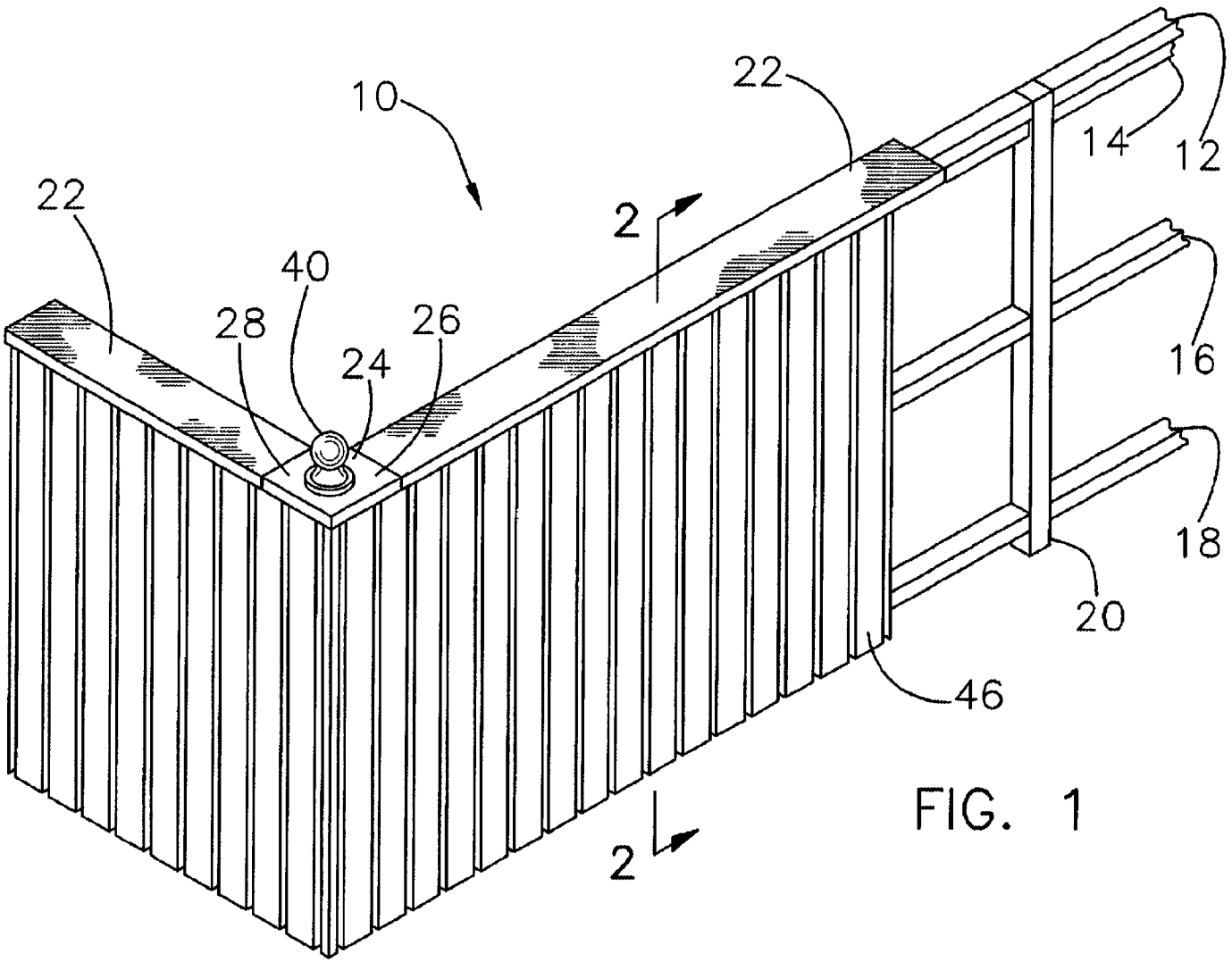
FIG. 1 is a diagrammatic view of the preferred embodiment of the weather resistant fence cover constructed in accordance with the principles of the present invention.
Figure 2:
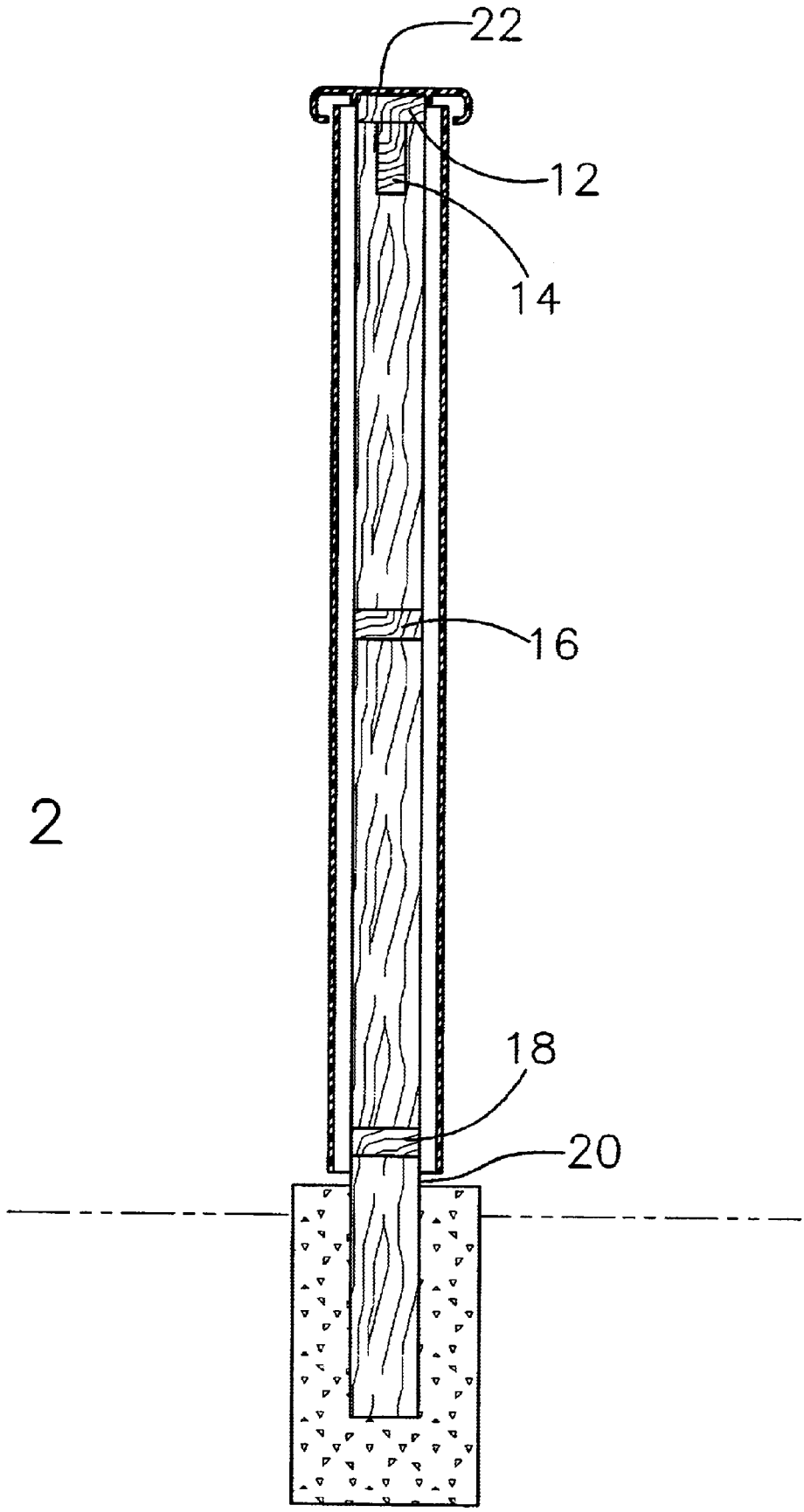
FIG. 2 is a cross-sectional view of the present invention, taken on line 2—2 in FIG. 1.

Referring now to the drawings, and particularly to FIGS. 1–2, a preferred embodiment of the weather resistant fence covering design of the present invention is shown and generally designated by the reference numeral 10. In FIGS. 1 and 2 the boards 12, 14, 16 and 18 are shown as two by fours and the post 20 is shown as a four by four. Clearly any dimension is appropriate.

In FIG. 1, a new and improved fence covering design 10 of the present invention for weather resistant fence covering is illustrated and will be described. More particularly, the weather resistant fence cover 10 has a top board 12 mounted horizontally to the post 20 and a board 14 mounted perpendicularly to the top board 12 to form a T-shape. The boards 16 and 18 are also mounted horizontally to the post 20. The top covering component 22, corner covering component 24 for covering facing ends of the top covering components 22 that are adjacent and not collinearlly-aligned, finial 40, and side covering component 46 are also shown.

FIG. 2 shows an enlarged cross sectional view taken along the line 2—2 in FIG. 1. The top board 12, perpendicular board 14, boards 16 and 18, post 20, top covering component 22 and side covering component 24 are shown.

Figure 3:
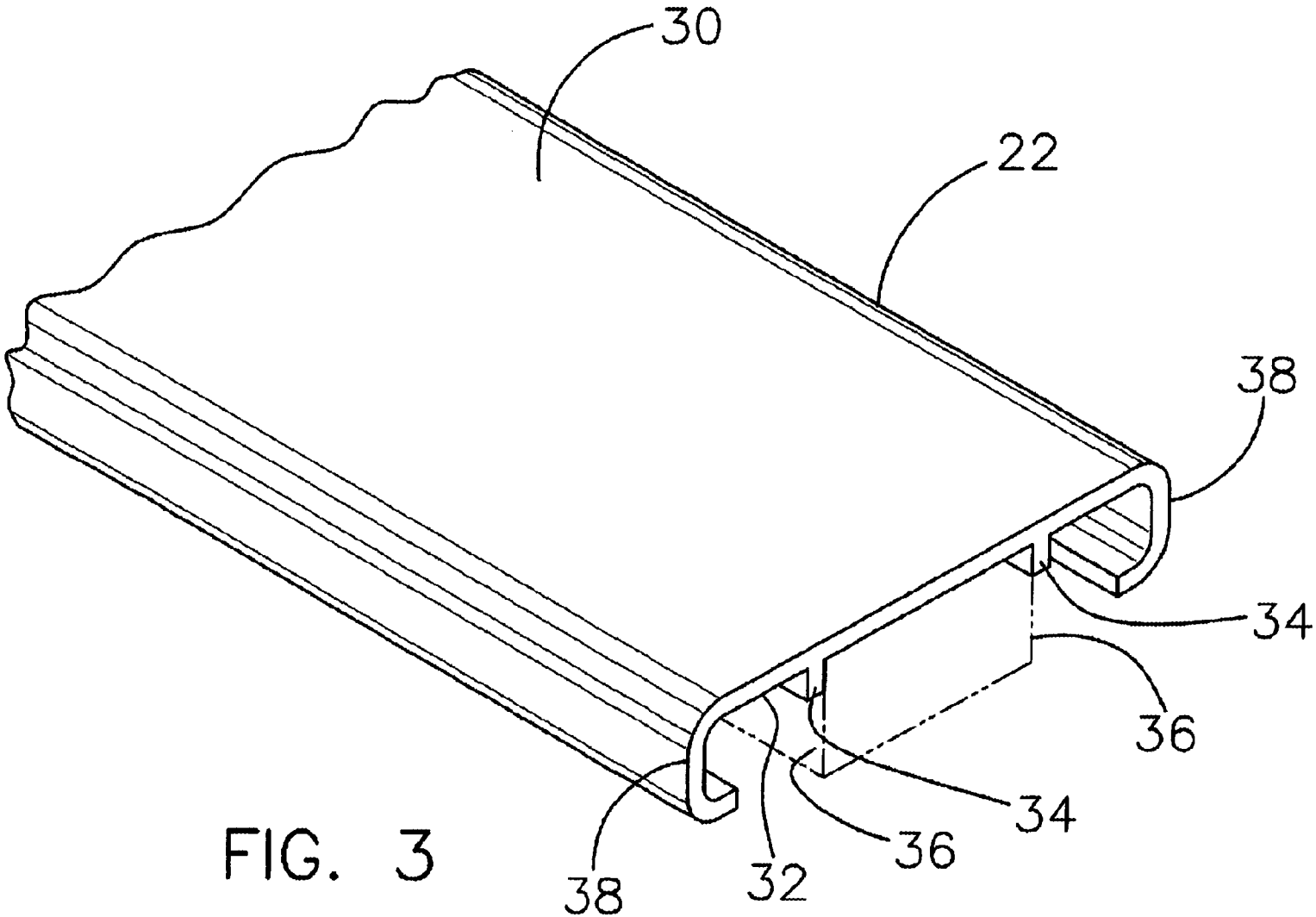
FIG. 3 is a perspective view of the top covering component of the present invention, with parts broken away.

The configuration of the top covering component 22 can be best seen in FIG. 3, and as such shall be discussed with reference thereto.

The top covering component 22 while not limited to may be typically fabricated out of preformed extruded plastic, elongated and generally horizontally oriented. The top covering component 22 has a top 30 that is horizontally oriented, flat, elongated, generally rectangular shaped, a bottom 32 that is elongated and generally horizontally oriented and free of any outwardly projections so as to allow it to directly abut the top of the rail 12 so as to eliminate any space therebetween, flanges 34 that are vertically-oriented, flat, elongate and rectangularly shaped, and extend perpendicularly downwardly from the bottom 32 that abut the sides 36 of the rail 12, and opposed downwardly curved J-shaped edges 38 that extend perpendicularly downwardly from the top 30.

Figure 4:
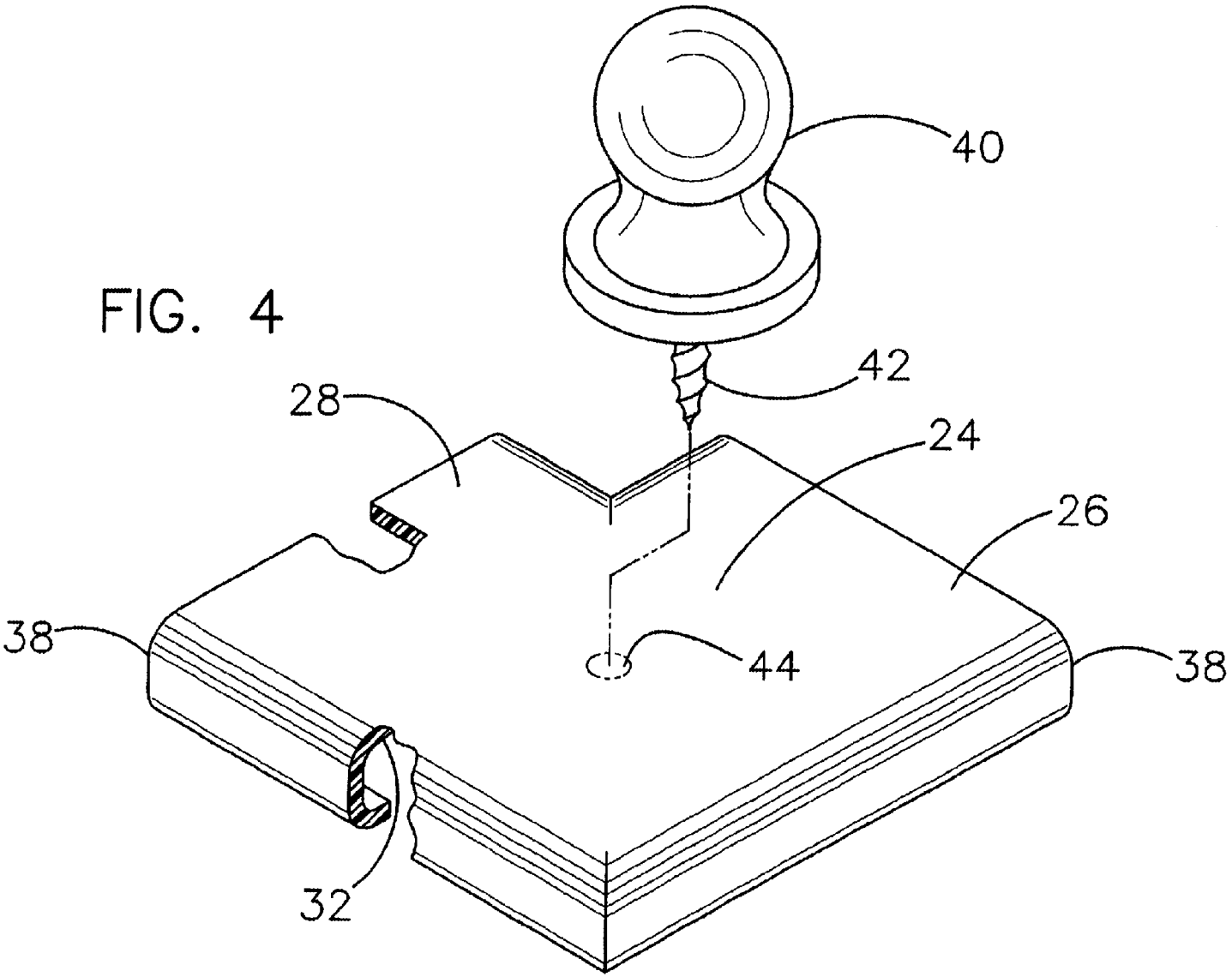
FIG. 4 is a perspective view of the corner covering of the present invention, with cutaway features.

FIG. 1 shows the use of a corner covering component 24, and FIG. 4 shows the corner covering component 24, opposed downwardly curved J-shaped edges 38 and finial 40, screw 42, and attachment hole 44, apart from the other components of the invention. The illustrated corner covering component 24 is to go round a right-angle in the fence and comprises first 26 and second 28 parts at 90° to each other. It will be appreciated that the angle can be made to suit any angle in the fence but a right angle is probably the most common. The same reference numbers are used in FIG. 4 as in FIG. 3 as the structure of the corner covering component 24 is the same as the top covering component 22.The corner covering component 24 is preformed extruded plastic and generally L-shaped. The corner covering component 24 has a top 30 that is horizontally oriented, flat, elongated, generally rectangular shaped, a bottom 32 that is elongated and generally horizontally oriented and free of any outwardly projections so as to allow it to directly abut the top of the rail 12 so as to eliminate any space therebetween, flanges 34 that are vertically-oriented, flat, elongate and rectangularly shaped, and extend perpendicularly downwardly from the bottom 32, that abut the sides 36 of the rail 12, and opposed downwardly curved J-shaped edges 38 that extend perpendicularly downwardly from the top 30. The corner covering component 24 has a top 30, that is horizontally-oriented, flat generally L-shaped and abuts directly against the top 30 of adjacent and not collinearlly-aligned top covering components 22 while covering any gaps therebetween.

In use, it can now be understood that the present invention provides a structure that can easily and economically made and yet provides great resistance to wear and weathering. It is useful for use outdoors as a cover for a fence. The cover greatly improves the durability of the fence but also improves its appearance and function as a screen and thus increases privacy and security.

While a preferred embodiment of the weather resistant fence cover has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A covering for a fence having a plurality of boards connected to a plurality of posts comprising:

a top covering component that is attachable to the top rail of a fence rail that has a top, a pair of sides, and a bottom, while covering most of the rail of the railing and any exposed ends thereof; and a corner covering component that is attachable to the corners of the top rail of a fence rail that has a top, a pair of sides, and a bottom, for joining facing ends of said top covering component that are adjacent and not collinearlly-aligned, wherein said corner covering component comprises integral first and second parts at an angle to each other other than 180°, wherein said top of said corner covering component is horizontally-oriented, elongated and free of any outwardly extending projections; and said bottom of said corner covering component is horizontally-oriented flat, elongated, and free of any inwardly extending projections so as to allow it to abut directly against the top of the rail of the railing and eliminate any space therebetween and has a pair of flanges that are vertically-oriented, flat, elongated and extend perpendicularly downward from said bottom of said corner covering component and which are abutable directly against the pair of sides of the rail of the top railing.

2. The covering of claim 1, wherein said corner covering component has a pair of sides that are vertically-oriented, elongated and J-shape, and extend downward from said corner covering component at its longitudinal edges.

3. The covering of claim 2, wherein said corner covering component has a finial that has an attached screw or other form of attachment for attachment to said corner covering component.

4. The covering of claim 2, wherein said corner covering component has a pre-drilled or preformed hole for attachment of said finial to said corner covering component.

* * * * *